United States Patent [19]

Rutherford et al.

[11] Patent Number: 4,661,245

[45] Date of Patent: Apr. 28, 1987

[54] SCREENING SYSTEM

[75] Inventors: William Rutherford, Valentine; David J. Tinson, Belmont North, both of Australia

[73] Assignee: Fioris Pty Ltd., Islington, Australia

[21] Appl. No.: 648,164

[22] PCT Filed: Nov. 4, 1983

[86] PCT No.: PCT/AU83/00161

§ 371 Date: Nov. 14, 1984

§ 102(e) Date: Nov. 14, 1984

[87] PCT Pub. No.: WO84/02290

PCT Pub. Date: Jun. 21, 1984

[30] Foreign Application Priority Data

Dec. 9, 1982 [AU] Australia ..... PF7191

[51] Int. Cl.[4] ..... B07B 1/04; E04C 5/04

[52] U.S. Cl. ..... 209/399; 209/405; 209/408; 209/412; 52/476; 52/507; 52/668

[58] Field of Search ..... 209/399, 405, 408, 414, 209/412, 395, 403; 52/475–477, 667, 668, 126, 5, 666, 316, 507, 312, 510

[56] References Cited

U.S. PATENT DOCUMENTS

| | | | |
|---|---|---|---|
| 1,085,043 | 1/1914 | Hodgdon | 209/405 |
| 1,856,450 | 5/1932 | Xistris | 209/414 |
| 2,068,413 | 1/1937 | Hunsicker | 209/408 |
| 2,073,130 | 3/1937 | Wallace | 52/386 |
| 2,082,241 | 6/1937 | Bennett | 52/387 |
| 2,105,245 | 1/1938 | Hohl | 52/475 |
| 2,740,525 | 4/1956 | Wehner | 209/399 |
| 4,120,784 | 10/1978 | Hassall | 209/399 |
| 4,219,412 | 8/1980 | Hassall | 209/408 |
| 4,265,742 | 5/1981 | Bücker et al. | 209/405 |
| 4,383,919 | 5/1983 | Schmidt | 209/405 |
| 4,409,099 | 10/1983 | Wolff | 209/405 |

FOREIGN PATENT DOCUMENTS

| | | | |
|---|---|---|---|
| 72663 | 2/1976 | Australia . | |
| 12698/76 | 8/1979 | Australia . | |
| 29598/77 | 6/1980 | Australia . | |
| 66007/81 | 7/1981 | Australia . | |
| 48398/79 | 8/1981 | Australia . | |
| 2754044 | 4/1979 | Fed. Rep. of Germany | 209/399 |
| 2849838 | 9/1979 | Fed. Rep. of Germany | 209/399 |
| 3031057 | 2/1982 | Fed. Rep. of Germany | 209/405 |
| 74/5092 | 8/1974 | South Africa | 209/399 |
| 75/6585 | 10/1975 | South Africa | 209/399 |
| 2037618 | 7/1980 | United Kingdom . | |

*Primary Examiner*—S. Leon Bashore
*Assistant Examiner*—Thomas M. Lithgow
*Attorney, Agent, or Firm*—Hopgood, Calimafde, Kalil, Blaustein & Judlowe

[57] ABSTRACT

A modular screening system which includes a plurality of screening modules supported in an interlocking manner of clamping bars secured to and positioned across a screening machine in parallel spaced relationship. The modules have a peripheral portion defined by side and end walls with a plurality of openings extending through the modules inwardly of the peripheral portion. The side and end walls of the modules are provided with interengaging means which interlock with longitudinal and transverse channels in the clamping bars to secure the modules in position in the machine, the modules are provided with interengaging means whereby the modules interlock together.

8 Claims, 7 Drawing Figures

SCREENING SYSTEM

The present invention relates to a new and improved modular screening system for use in screening machines.

Modular screening systems are known and were developed to overcome the problem of localised wear in a continuous screening mat which was used in such machines.

The present invention provides an improved modular screening system for use with screening machines.

SUMMARY OF THE INVENTION

In accordance with the present invention there is provided a modular screening system which includes: a plurality of screening modules supported on clamping bars secured to and positioned across a screening machine in parallel space relationship, said modules having a peripheral portion defined by side and end walls and a plurality of opening extending through said modules inwardly of the peripheral portion, the side and end wall of the modules being provided with inter engaging means which interlock with longitudional and transverse channels in said clamping bars to secure said modules in position in the machine.

According to one embodiment the interengaging means comprises protuberances on the side and end walls of each module.

In a modification the interengaging means comprises protuberances on the inside faces of the side walls of the modules and a transverse rail interlocked with the end walls of the modules.

The invention will be now more particularly described with reference to the preferred embodiments shown in the accompanying drawings.

DETAILED DESCRIPTION OF THE INVENTION

Figure 1:
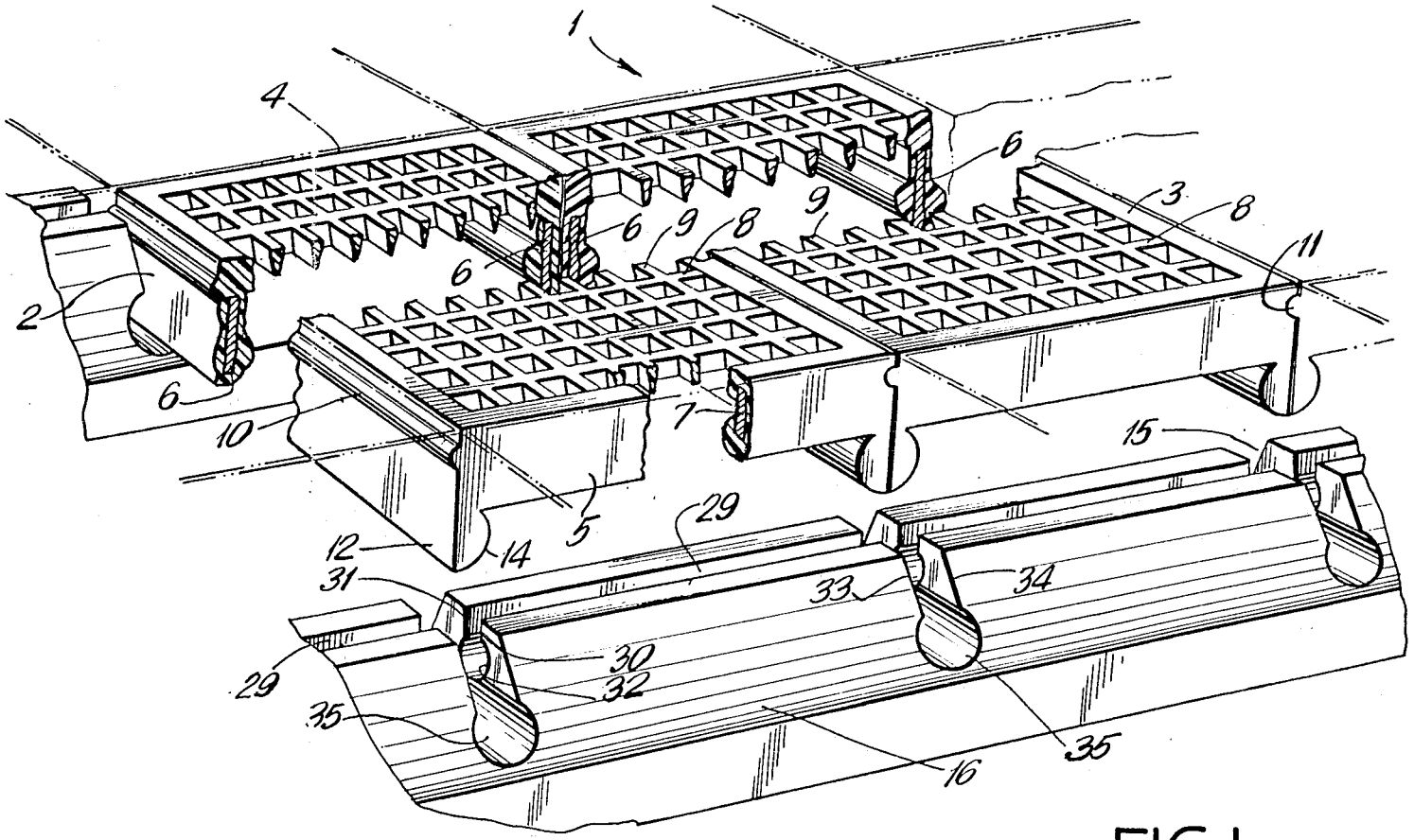
FIG. 1 is an exploded respective view illustrating two modules and two clamping bars according to one embodiment of the invention.

Referring now to the drawings. The screening module is designated generally by the reference 1. It is preferably made from polyurethane and has ends 2 and 3 and sides 4 and 5 defining the peripheral portion of the module. The module is conventiently formed in a molding operation, the peripheral portion is provided with reinforcement preferably in the form of steel strips or bars 6 and 7 and in addition the module is provided with a plurality of openings formed by longitudinal members 8 and transverse members 9. These members may be provided with reinforcement in the form of reinforcing bars embedded in the longitudinal member 8 and transverse members 9. The size of the openings will be selected to suit the particular requirements of the material to be screened.

Figure 5:
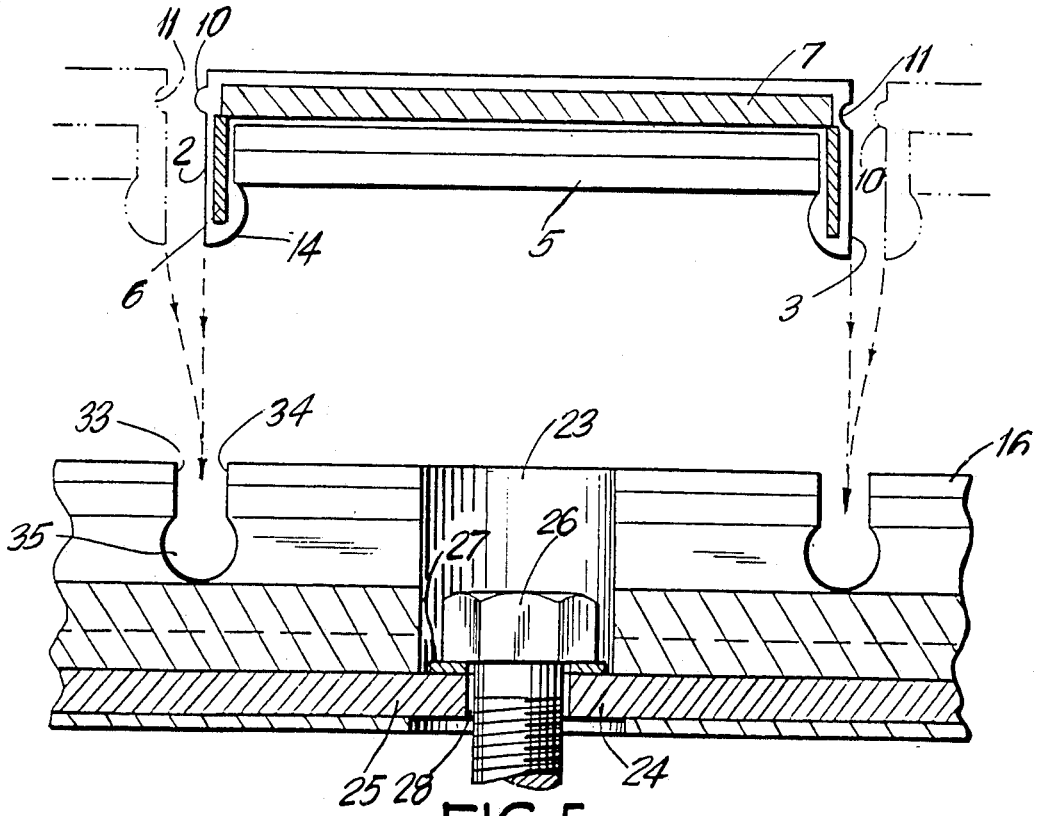
FIG. 5 is a detailed sectional view on line V—V of FIG. 2.

As illustrated in FIG. 1 adjoining modules are designed to interlock one with the other and to be firmly and accurately supported on clamping bars 16 in such a manner which will prevent small pieces of aggregate, dust particles and water from penetrating between mating services thereby minimising wear. To this end each end wall 2 is provided with a longitudionally extending protuberance 10 while the opposite end 3 is provided with a longitudionally extending channel 11 as clearly shown in FIG. 5. The channel 11 is so shaped and dimensioned as to accurately accommodate and mate with the protuberance 10 of an adjoining module as illustrated in FIG. 5.

Figure 6:
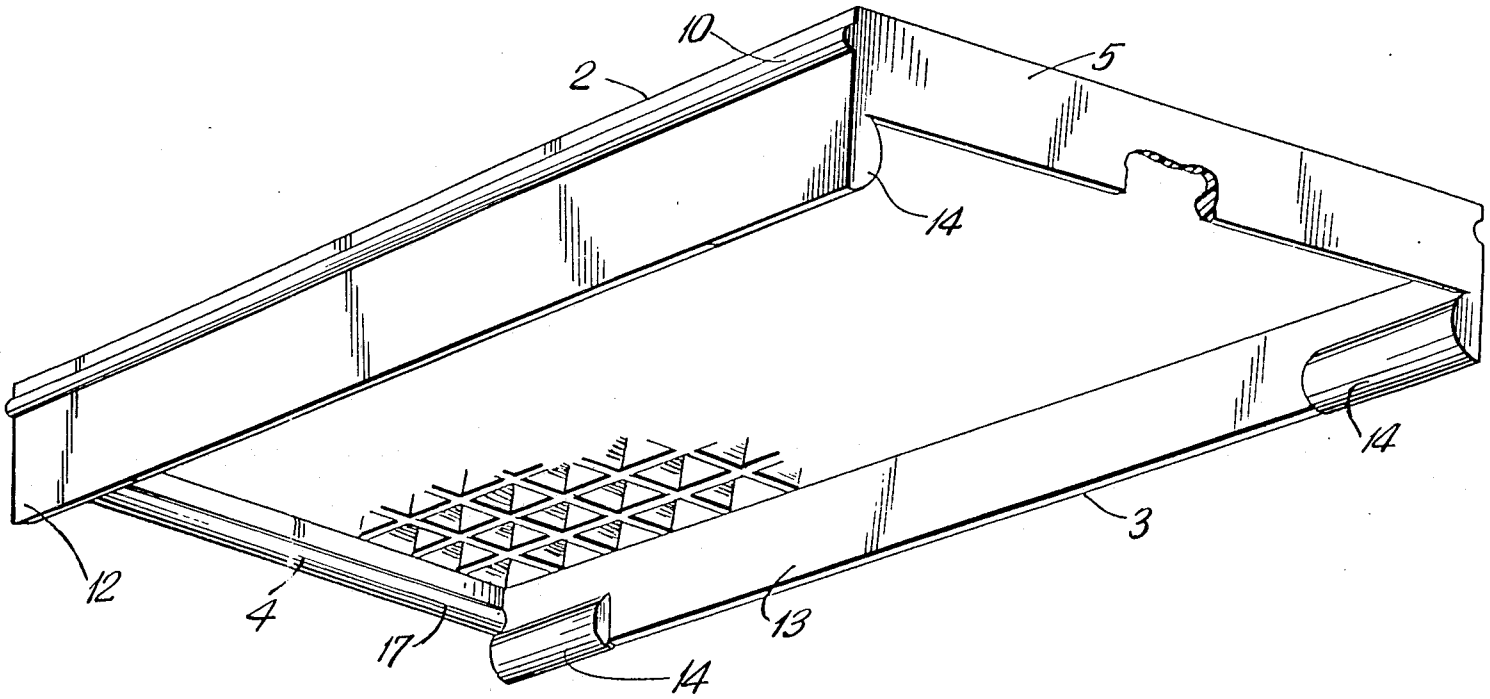
FIG. 6 is a perspective view of the under sides of a module.

The end walls 2 and 3 each include an integral skirt portion 12 which extend below the bottom edge of the side walls 4 and 5 illustrated in FIG. 6. The inner face 13 of this skirt is provided with an arcuate shape protuberance 14 (FIG. 6). Whilst it is possible for these protuberances to extend throughout the length of the skirt it is preferred that they only extend for such a length as to be completely accommodated in a transverse channel designated generally by the reference 15 in the clamping bar 16 as illustrated in FIG. 1. The inner faces of the side walls 4 and 5 are each provided with a protuberance 17 which may extend throughout the length of the end walls or only part way as circumstances dictate.

Figure 2:
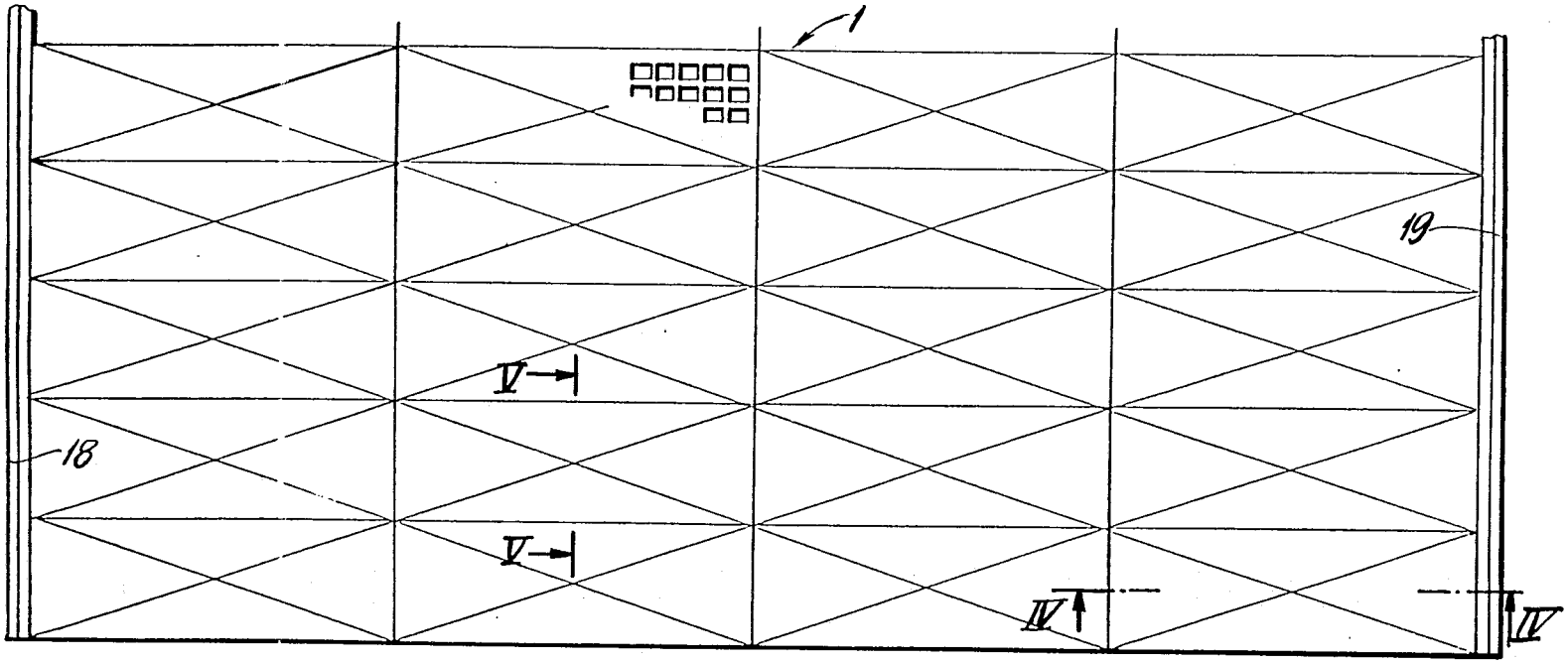
FIG. 2 is a diagramatic plan view of an assembly of modules.
Figure 3:
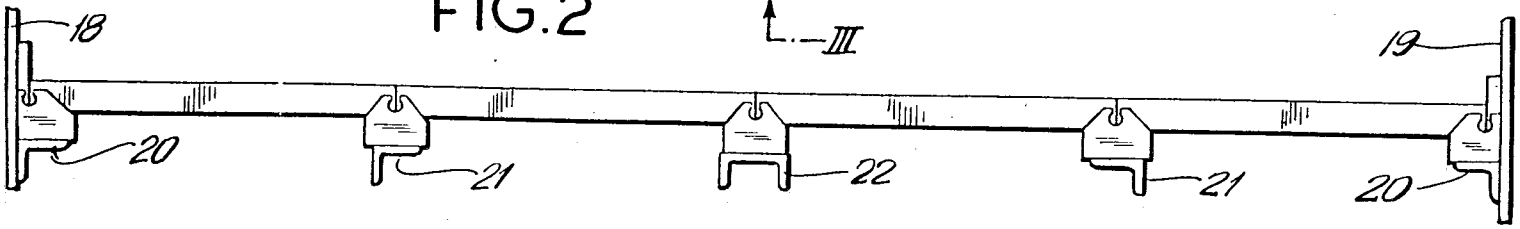
FIG. 3 is a diagramatic side view in the direction of the arrow III on FIG. 2.

The clamping bars 16 are also preferably made of polyurethane and extend over the length of the machine, the side wall of which are identified by the reference numerals 18 and 19 in FIGS. 2 and 3. Each bar seats on support members 20, 21 and 22. The support members are preferably made from steel and are secured over the length of the machine in parallel spaced relationship. The members 20 and 21 are conventiently formed as right angle shaped bars; whilst the members 22 which are located in the centre of the machine are channel shaped for greater strength.

Each clamping bar 16 is provided with bores 23 which are spaced along each bar so as to register with the support members 20, 21 and 22. The bore passes through a reinforcing bar 24 embedded in the clamping bar during the manufacture thereof. Bolts 26 seating on washers 27 pass through holes 28 in the reinforcing bar 24 and are secured by nuts (not shown) to the support members 20 21, and 22.

Each clamping bar is provided with a centrally located longitudionally extending channel 29 in its upper face and of course the transverse channels 15 previously referred to. The longitudional channel 29 has straight side walls 30 and 31 forming lips leading to a circular shaped bottom portion 32. The transverse channels 15 likewise have straight side walls 33 and 34 also forming lips leading into a circular shaped bottom portion 35. As will be apparent from FIG. 1 the longitudional channels 29 intersect the transverse channels 15 at right angles.

With the support members secured in the machine and the clamping bars secured to the support members in the manner previously described the screening modules 1 are locked in position as follows. The module is positioned on the clamping bars with the end walls 2 and 3 in register with the horizontal channels 15 and the side walls 4 and 5 in register with the longitudional channels 29. The module is then pressed downwardly so that the sides and end walls of the module enter the horizontal channels 15 and the longitudional channels 29. Adjoining modules are positioned and locked in position in the same manner, there being sufficient resiliency in the lips formed by the walls 30, 31 and 33, 34 to permit the sides and ends of the module to be tightly locked in the respective channels.

As will be apparent from FIG. 1 the protuberances 10 of each module snap into the channel 11 of an adjoining module. The interlocking of adjoining modules and the locking of the respective modules to the clamping bar in the manner described insures a tight fit and so dust and aggregate particles and moisture cannot penetrate between the interfaces of the components thereby minimising wear and ensuring long life. Additionally no separate fasting means are used and worn or damaged modules may be removed and replaced in a matter of seconds.

Figure 4:
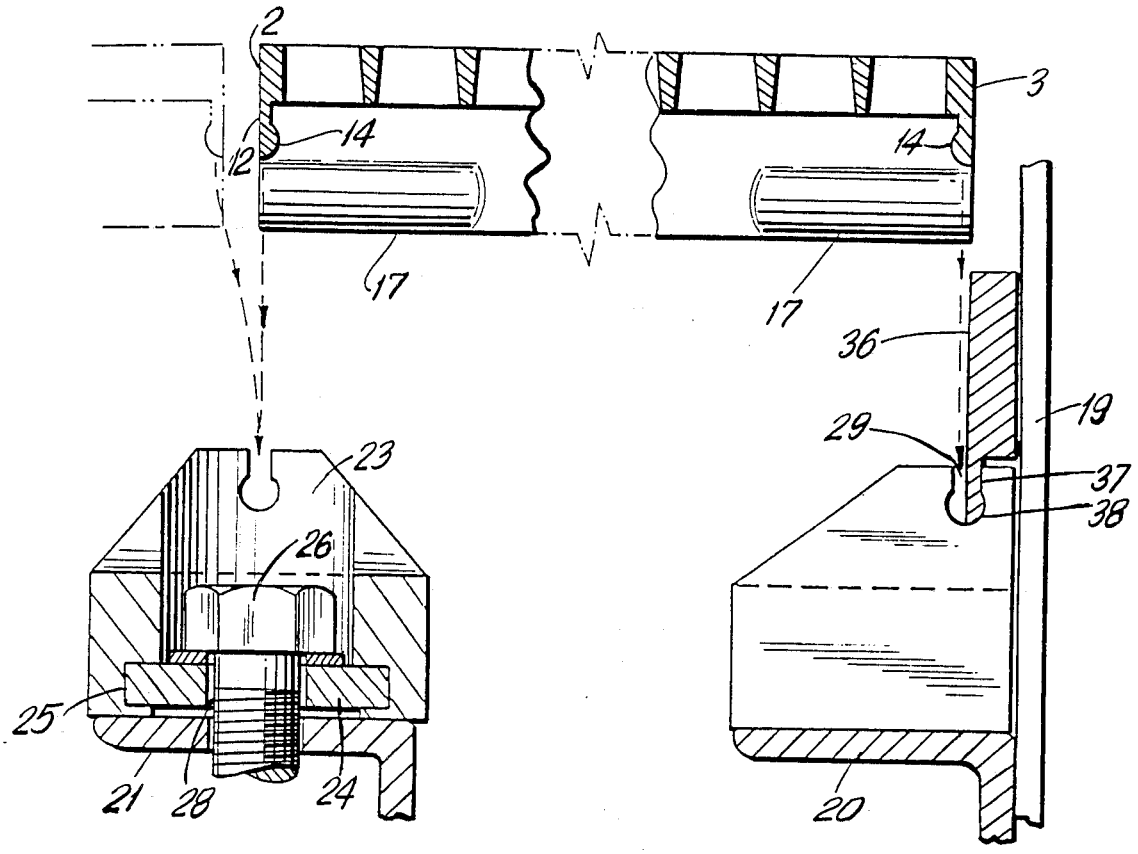
FIG. 4 is a detailed cross sectional view on line IV—IV of the modules of FIG. 2.

Wear plates 36 are provided to protect the side walls 18 and 19 of the machine. These plates are preferably made from polyurethane and as indicated in FIG. 4 they include a longitudionally extending body having a downwardly extending tongue 37 having the bottom portion of its side face formed with a protuberance 38 of the same configuration as the bottom portion 35 of the channel 29. In use the tongue snaps into the longitudional channel 29 and bears tightly against the adjoining module and the wall.

Figure 7:
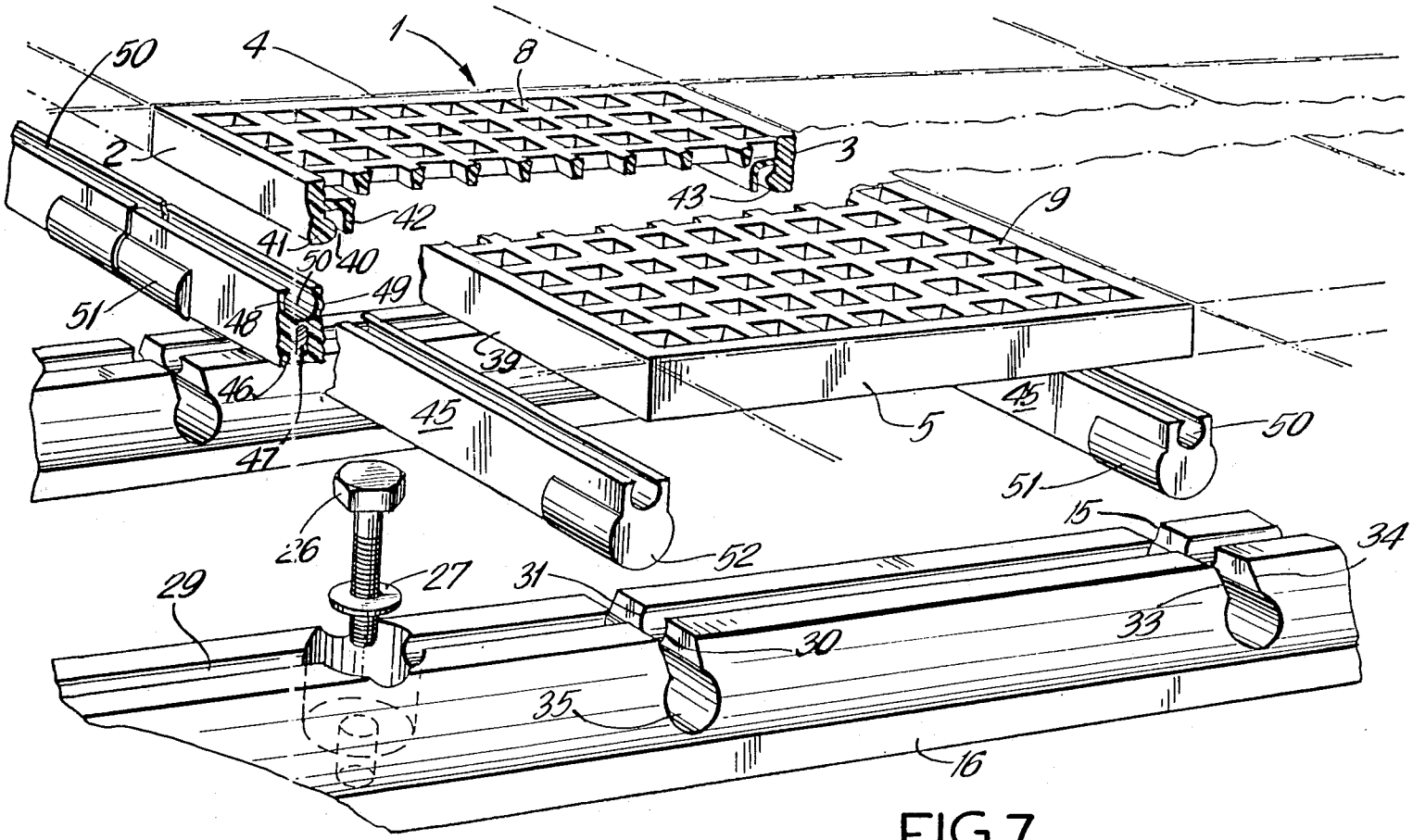
FIG. 7 is a perspective view similar to FIG. 1 illustrating another embodiment of the invention.

Referring now to the embodiment of the invention illustrated in FIG. 7 in which like parts are given the same reference numerals as that of the previous embodiment.

The module 1 has end walls 2 and 3 and side walls 4 and 5 defining the peripheral portion of the module. As in the case of the previous embodiment the module is formed of polyurethane in a moulding operation. The peripheral portion does not however include the reinforcement described in the previous embodiment. The module is however provided with a plurality of apertures formed by the transverse members 8 and the longitudional members 9.

In the case of this embodiment the bottom edge 39 of the end walls 2 and 3 is provided with a downwardly opening channel 40 having limbs 41 and 42. The inner face of the limb 41 is provided with an inwardly directed protuberance 43. The protuberance may extend throughout the length of the end walls of the module or it may only extend over a portion of the length as circumstances dictate.

The modules are supported on rails designated generally by the reference 45 which in turn are supported on the clamping bars 16. The bar 16 seats on the support members 20, 21 and 22 and is secured thereto by bolts 26. The clamping bars are provided with horizontal channels 15 and longitudional channels 29 as described in the previous embodiment.

The rails 45 extend transversely across the machine and are adapted to seat in the transverse channels 15. Each rail is substantially U-shaped having a bight portion 46 with a reinforcing bar 47 embedded therein and extending throughout the length of the rail. Limbs 48 and 49 extend upwardly from the bight portion and define a channel 50. In order to ensure a tight interfit with the transverse channel 15 the outer faces of the side walls of the rail are provided with arcuate shaped protuberances 51 and the outer face of the bottom portion of the rails are rounded as at 52 to provide a section which is complementary to the shape of the transverse channels 15. As will be apparent from FIG. 7 the rails 45 snap into the transverse channels 15 and are tightly engaged thereby with the surface of the rails and the clamping bars being planar.

The clamping bars and rails form a grid like structure which extends across the machine and supports the modules. The modules are simply pressed into the longitudional channels 29 and the channels 50 in the rails 45 with the protuberances 40 engaging the inner face of the channels 50. Adjoining modules are likewise pressed into their respective transverse and longitudional channels thereby forming a rigid tightly interlocked screening structure.

As in the case of the previous embodiment worn or damaged modules may be replaced within a very short time without the necessity of releasing special securing means such as nuts, bolts, screws and the like. Wear plates 36 protect the sides 18 and 19 of the machine in the same manner as described with the reference to the previous embodiment.

What is claimed is:

1. A modular screening system positioned and lockingly supported across a screening machine, said modular screening system comprising a plurality of screening modules with screen opening therein, each module being characterized by a rectangular periphery defining end walls and side walls, said modules being disposed in parallel and contacting relationship with each other, protuberance means extending along an outer face of one end wall of each module, and channel means extending along an outer face of the other end wall thereof, such that the end wall protuberance means of one of said modules interengages and mates with end wall channel means of an adjacent module, clamping bars disposed in spaced relationship across said screening machine beneath said modular screening system, each of said spaced clamping bars being disposed transverse to the end walls of said modules, each of said clamping bars having a longitudinal channel running along its length with spaced channel locking means disposed transversely to said bar and the longitudinal channel thereof, detachable rails disposed below said screen modules in spaced relationship across and transverse to said clamping bars and to the side walls of said modules and above said clamping bars, each of said rails having locking means in the form of protuberance means which snap-fit into said transverse channel locking means on said clamping bars, each of said rails having channel means longitudinally disposed therein, protuberance means located at the bottom of each module end wall which snap-fit into said rail channel means disposed along each of said spaced rails, and protuberance means located at the bottom of the side walls of each module which snap-fit into the longitudinal channels of said clamping bars, whereby adjacent modules are interlocked relative to each other and to the rails and the clamping bars.

2. The modular screening system of claim 1, wherein the protuberance means on the inside faces of each side and end wall of each module are semicircular and extend at least part way along the length of each of said walls, each of said protuberance means and adjoining wall sections being so dimensioned as to occupy approximately one half the width of the corresponding rail and clamping bar channel means, the other half of the width of the said channel means being occupied by the protuberance means and adjoining wall sections of the side and end walls of an adjoining module, whereby said modules are locked in position on said rails and said clamping bars.

3. The modular screening system as claimed in claim 1, wherein the transverse channel means of the clamping bars intercept the longitudinal channel means thereof at right angles, said transverse channel means being deeper than the longitudinal channel means, said transverse and longitudinal channel means of said clamping bars having a keyhole shape in cross-section.

4. The modular screening system as claimed in claim 1, wherein the protuberance means on each side wall of said rails extend at least part way along the length of each side wall, said protuberance means on said rail having a shape which is complementary to the shape of the transverse channels in said clamping bars and is capable of being snap-fitted therein.

5. The modular screening system as claimed in claim 4, wherein the modules are supported on said clamping bars and rails, the rails being provided with interengaging means which interlock with the transverse channel means in said clamping bars and thus provide a grid structure extending across the machine, the bottom edge of the end wall of each module being provided with a downwardly opening channel means, one wall of which has protuberance means extending inwardly into the channel and which is complementary in shape to the shape of half the cross-sectional shape of the channel in said rail, said protuberance means being adapted to enter and seat in one half of said channel, the protuberance means of an adjoining module being adapted to enter and seat in the other half of the said channel means, whereby adjoining modules are locked in the said rail.

6. The modular screening system as claimed in claim 4, whereby said rail has a reinforcing bar embedded therein.

7. The modular screening system as claimed in claim 1, wherein said clamping bar is secured to support members extending across said machine.

8. The modular screening system as claimed in claim 1, wherein wear plates are provided to protect the sides of the screening machine, said wear plates having a tongue provided with protuberance means which is complementary in shape to substantially half the cross-sectional shape of the longitudinal channel means of said clamping bars, said tongue being adapted to enter into said channel and to be locked therein with the side walls of an adjoining module.

* * * * *